US007108676B2

(12) United States Patent
Loging

(10) Patent No.: US 7,108,676 B2
(45) Date of Patent: Sep. 19, 2006

(54) CUP FOR ADMINISTERING MEDICINE TO A CHILD

(76) Inventor: James A. Loging, 159 Bonnie Woods Dr., Greenville, SC (US) 29605

( * ) Notice: Subject to any disclaimer, the term of this patent is extended or adjusted under 35 U.S.C. 154(b) by 224 days.

(21) Appl. No.: 10/846,799

(22) Filed: May 4, 2004

(65) Prior Publication Data

US 2005/0247719 A1 Nov. 10, 2005

(51) Int. Cl.
*A61J 7/00* (2006.01)

(52) U.S. Cl. ..... 604/78; 220/714

(58) Field of Classification Search ..... 604/78, 604/74, 77, 218; 220/592.11, 714, 521, 501, 220/502, 505, 524, 251, 717, 703, 504; 222/129, 222/145, 129.1, 133; 206/220, 568, 219, 206/221; 202/145.1, 145.5, 212, 494, 482
See application file for complete search history.

(56) References Cited

U.S. PATENT DOCUMENTS 3,302,644 A * 2/1967 Kennedy et al. ..... 604/78
5,244,122 A 9/1993 Botts
5,269,425 A 12/1993 Gomez-Acevedo
5,353,964 A 10/1994 Liu et al.
5,611,776 A 3/1997 Simmons et al.
5,620,462 A * 4/1997 Valenti ..... 606/234
5,706,973 A * 1/1998 Robbins et al. ..... 220/714
6,050,445 A * 4/2000 Manganiello ..... 220/714
6,270,519 B1 8/2001 Botts
6,422,415 B1 7/2002 Manganiello
6,981,962 B1 * 1/2006 Lenkersdorf ..... 604/78
2003/0192911 A1 * 10/2003 Jacobs et al. ..... 222/129

* cited by examiner

*Primary Examiner*—Nicholas D. Lucchesi
*Assistant Examiner*—Christopher D. Koharski
(74) *Attorney, Agent, or Firm*—J. Bennett Mullinax, LLC

(57) ABSTRACT

A cup for administering medicine is provided. The cup allows for the separate storage of a first fluid and a second fluid. When a child or adult drinks from the cup, the two fluids are mixed with one another in order to help mask the taste of one of the fluids should that fluid have an undesirable taste. The cup includes a cup body that defines a chamber for holding the first fluid, and the cup has a lid adapted to engage the cup body. The cup body and the lid are in fluid communication with one another to allow the first fluid to be dispensed. The cup also has a container adapted to be located inside of the cup body and configured for holding the second fluid. The container and the lid are in fluid communication with one another to allow the second fluid to be dispensed.

12 Claims, 6 Drawing Sheets

CUP FOR ADMINISTERING MEDICINE TO A CHILD

TECHNICAL FIELD OF THE INVENTION

The present invention relates generally to a cup used to administer medicine to a child that allows a supervising adult to note the amount of medicine actually delivered. More particularly, the present invention relates to a cup that has a medicine container from which medicine may be dispensed and mixed with a beverage in the cup for consumption by a child.

BACKGROUND

Medicine for children is often provided in a liquid form in order to aid a parent in administering the medicine to the child. Unfortunately, medicine often has an unpleasant taste, and children will refuse to take the medicine. A child will associate the use of a spoon, syringe, or medicine dropper with the administration of medicine, and its associated unpleasant taste, and will subsequently resist a parent's attempts to administer the medicine. Additionally, a child may learn the taste, smell, color, and overall appearance of medicine and decline taking the medicine regardless of how the medicine is presented.

Attempts have been made to encourage children into taking medicine by disguising the medicine or administering process. For instance, a child may be given a cup with a see-through portion that allows the child to view an attractive looking drink inside of the cup. However, the bottom of the cup has a hidden chamber that holds liquid medicine. One end of a straw is placed into fluid communication with the medicine in the hidden chamber, and the other end of the straw is presented to the child. The child may take a sip from the straw and think he or she is drinking the attractive looking drink in the cup, but the child will actually be drinking medicine directly from the hidden chamber. While this arrangement may initially fool the child, the child will become wise to this trick and subsequently refuse to drink from the cup since the taste will be of the unpleasant tasting medicine.

Medicine may also be administered to a child by mixing the medicine with a beverage that the child likes. For instance, medicine may be mixed with a particular type of juice that a child is familiar with and enjoys. Administering medicine in this type of manner may be problematic for some types of medicine in that the medicine will become disadvantageously diluted upon mixing. Also, inaccurate dosing will occur if the child only drinks some of the contents of the cup. In such an instance, the parent will not know the amount of medicine that was actually consumed by the child and the amount left in the cup.

Accordingly, a cup that allows a parent to know the amount of medicine actually delivered to the child and that masks the unpleasant taste of the medicine from the child would be useful.

SUMMARY

Various features and advantages of the invention will be set forth in part in the following description, or may be obvious from the description or may be learned through practice of the invention. The present invention provides for a cup used for administering medicine to a child. The cup allows for the separate storage of a first fluid, such as a beverage, and a second fluid such as medicine. When a child drinks from the cup, the first and second fluids mix with one another in order to help mask the taste of one of the fluids should that fluid have an unpleasant taste.

In general, the cup includes a cup body that defines a chamber configured for holding the first fluid. A lid is adapted to engage one end of the cup body, and the cup body and lid are capable of being placed into fluid communication with one another in order to allow the first fluid to be dispensed from the chamber and out of the lid. The cup also includes a container that is adapted to be located inside of the cup body. The container is configured for holding the second fluid, and the container and lid are capable of being placed into fluid communication with one another in order to allow the second fluid to be dispensed from the container and out of the lid.

The container used in the cup of the present invention can have a variety of configurations and features. For instance, the container may have indicia located thereon for allowing the parent to be able to note the exact amount of second fluid present within the container. In this manner, the parent will be able to determine how much of the second fluid the child has consumed and the amount remaining. The longitudinal axis of the container may be parallel to the longitudinal axis of the cup body. Alternatively, the longitudinal axis of the container may be inclined with respect to the longitudinal axis of the cup body in accordance with various exemplary embodiments.

An embodiment of a cup as discussed above may further include a flow control element connected to the lid. The flow control element has a first fluid flow control valve for regulating the dispensing of the first fluid from the chamber to the lid. The flow control element likewise includes a second fluid flow control valve for regulating the dispensing of the second fluid from the container to the lid. The present invention further provides exemplary embodiments where the first and second flow control valves are made from an elastomeric material and are substantially cylindrical shaped with a slit on one end configured for opening and allowing the fluid to pass therethrough.

An alternate embodiment of a cup as discussed above may include a lid that defines a first and second vent, and the flow control element may include both a first and second vent valve. The first vent valve is used for regulating the transfer of air from the first vent into the chamber, and the second vent valve regulates the transfer of air from the second vent into the container. The first and second vents are useful in eliminating or reducing negative pressure that builds inside of the chamber and container that acts to hinder the dispensing of the first and second fluids therefrom. The first and second vent valves may be configured in a manner similar to the first and second fluid flow control valves as discussed above.

The flow control element may be a single, integral component. The container may be located at various locations with respect to the flow control element. The flow control element may define a passageway used for placing the second fluid flow control valve into fluid communication with the container. Additionally or alternatively, the flow control element may define a passageway for placing the second vent into fluid communication with the container.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

DETAILED DESCRIPTION OF PREFERRED EMBODIMENTS

Figure 1:
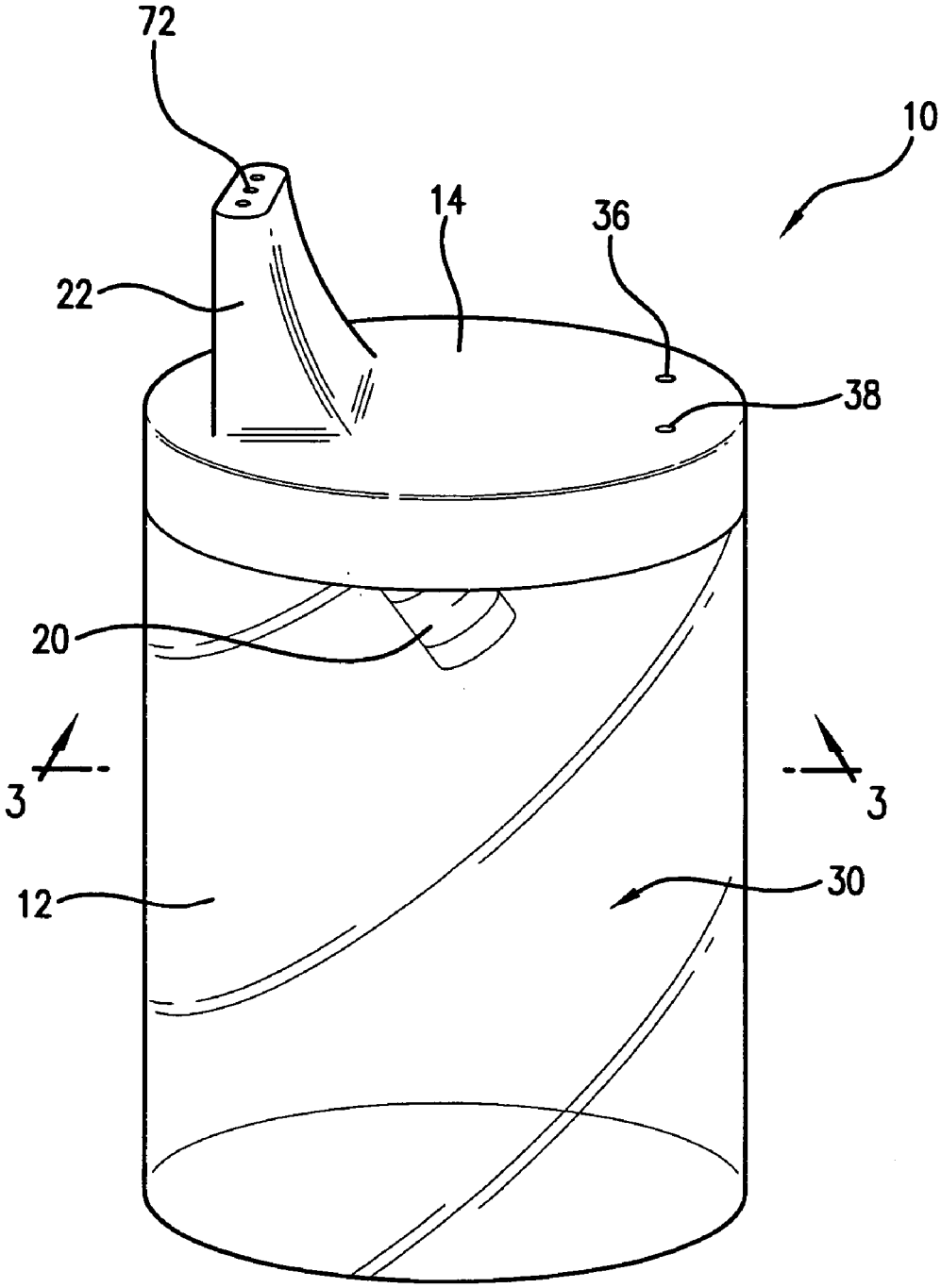
FIG. 1 is a perspective view of a cup in accordance with one exemplary embodiment of the present invention.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Figure 2:
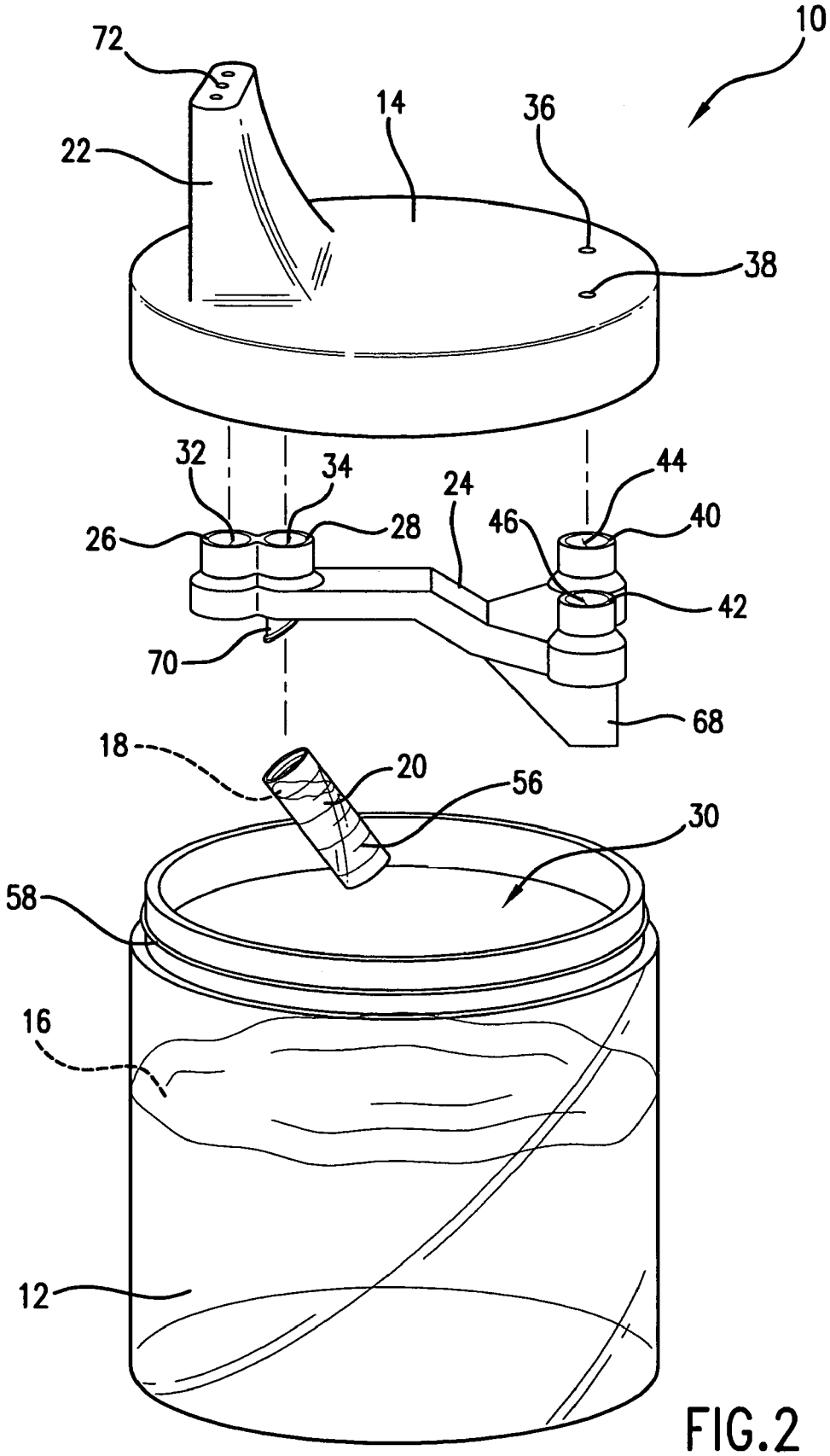
FIG. 2 an exploded assembly view of the cup of FIG. 1.

FIGS. 1 and 2 illustrate an exemplary embodiment of a cup 10 of the present invention that may be used for administering medicine to a child. The cup 10 is configured for storing separately a first fluid 16, that may be a beverage the child enjoys drinking, and a second fluid 18, that may be a liquid medicine a parent wishes to administer to the child. Upon taking a drink from the cup 10, the first and second fluids 16, 18 will mix with one another causing the child to drink both of the fluids 16, 18. The unpleasant taste of one of the fluids 16, 18 will be masked upon mixing with the other, and the parent will be able to determine the precise amount of medicine delivered to the child due to the fact the first and second fluids 16, 18 are stored separately in the cup 10.

Figure 3:
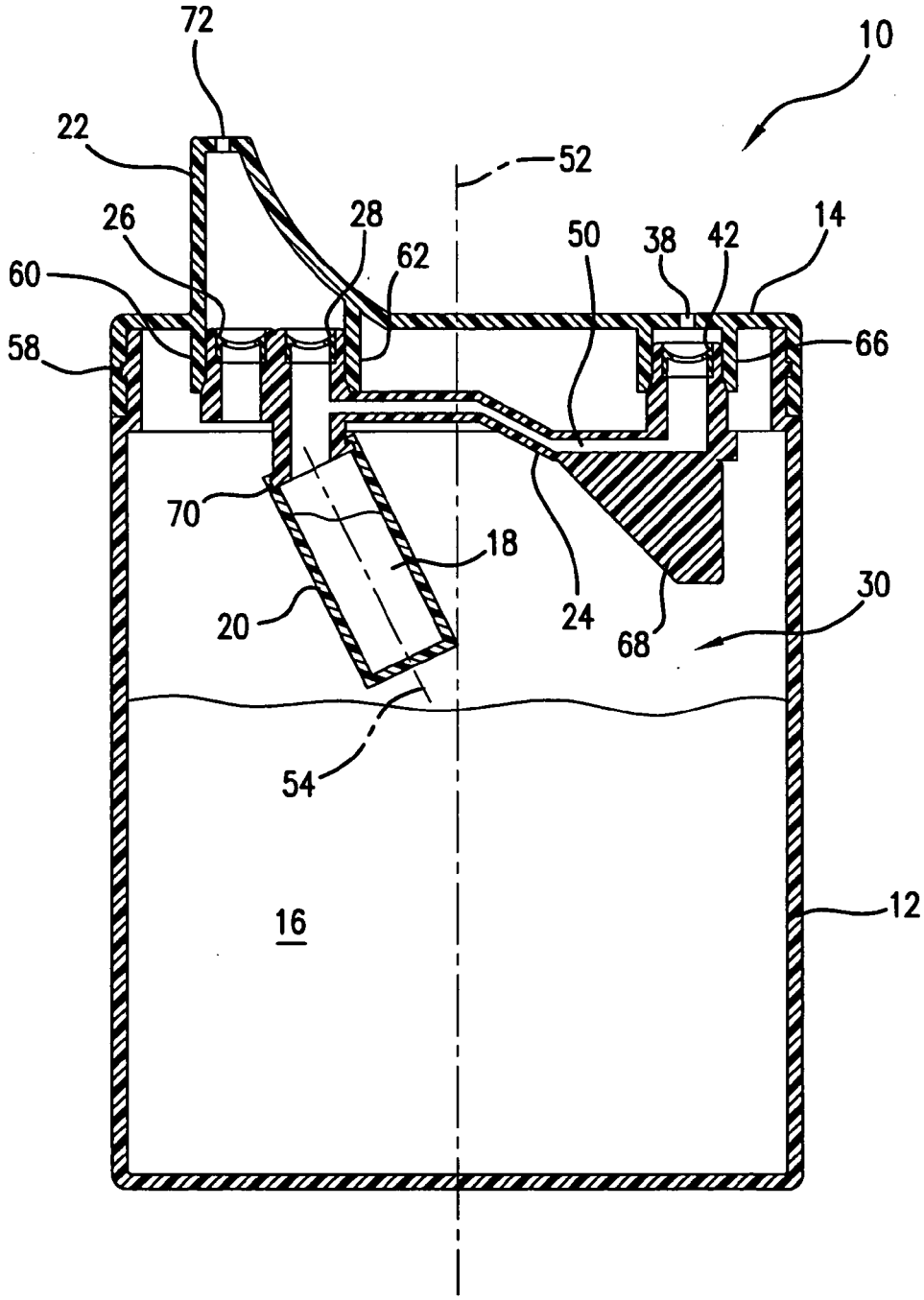
FIG. 3 is a cross-sectional view taken along line 3—3 of FIG. 1.

Cup 10 includes a cup body 12 that defines a chamber 30 capable of holding the first fluid 16. The cup body 12 may be opaque or transparent and can have any type of shape, and the cup body 12 may be provided with any number of features such as handles or grips, as is commonly known to one of ordinary skill of the art. A lid 14 may be attached to the open end of the cup body 12. As shown in FIG. 3, the attachment between the lid 14 and the cup body 12 is effected through a snap-fit connection 58. However, it is to be understood that any type of connection may be used in order to attach the lid 14 to the cup body 12, for instance a threaded connection may be employed. Additionally, in accordance with other exemplary embodiments of the present invention the lid 14 need not be a separate component from the cup body 12. In this instance the cup body 12 and lid 14 may be formed as a single, integral piece in which the first fluid 16 is inserted into the cup body 12 through a side or bottom opening.

A container 20 is located inside of the cup body 12 and is configured for holding the second fluid 18. In this manner, the first and second fluid 16, 18 are stored separate from one another and are not mixed at times when the child is not drinking from the cup 10. When filling the cup 10, a parent is able to ascertain the exact amount of the first fluid 16 and the second fluid 18 placed inside before giving the cup 10 to the child. The container 20 may be provided with indicia 56 in order to allow a parent to accurately measure the amount of the second fluid 18 present within the container 20. Further, the cup body 12 may be provided with similar indicia. The chamber 30 and container 20 are in fluid communication with a drinking spout 22 located on the lid 14. The drinking spout 22 is provided with one or more openings 72 through which the first and second fluids 16, 18 may be dispensed. A child may invert the cup 10 and suck on the drinking spout 22 in order to receive a drink. Doing so will cause both the first and second fluids 16, 18 to flow into the drinking spout 22 and mix with one another. As such, the child will receive both the first and second fluids 16, 18 when drinking. When the child is finished drinking, the parent may examine the cup 10 and note the amount of the first and second fluids 16, 18 remaining therein. If the second fluid 18 is medicine, the parent will be able to ascertain the exact amount of medicine administered to the child and the exact amount of medicine remaining in the cup 10.

Figure 4:
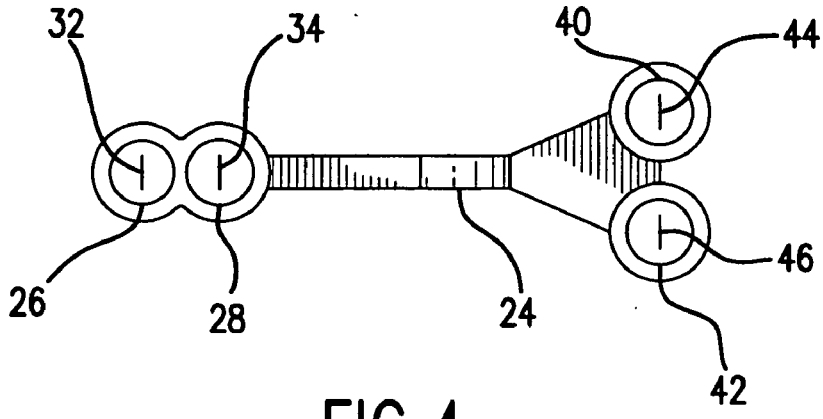
FIG. 4 is a top view of a flow control element used with the exemplary embodiment of the cup shown in FIGS. 1–3.

The cup 10 may be provided with a flow control element 24 in order to help regulate the amount of first and second fluids 16, 18 dispensed from the cup 10 and also to assist in making the cup 10 a spill-proof cup. An example of a flow-control element used in drinking cups may be found in U.S. Pat. Nos. 6,050,445 and 6,422,415 each entitled "Leak-proof cup assembly with flow control element." The entire contents of these two patents are incorporated by reference herein in their entirety for all purposes. The flow control element 24 includes a substantially cylindrically shaped first fluid control valve 26 through which the chamber 30 is placed into fluid communication with the drinking spout 22. The flow control element 24 also includes a substantially cylindrically shaped second fluid flow control valve 28 through which the container 20 is placed into fluid communication with the drinking spout 22. The first and second fluid flow control valves 26, 28 may have a top end that is substantially flat. As shown in FIG. 4, the first fluid flow control valve 26 is provided with a slit 32 on one end thereof, and the second fluid flow control valve 28 is likewise provided with a slit 34.

The first and second fluid flow control valves 26, 28 may be made of an elastomeric material. In fact, the entire flow control element 24 may be made of an elastomeric material in accordance with various exemplary embodiments of the present invention. When a child sucks on the drinking spout 22, he or she will create a negative pressure that will act to expand the slits 32, 34 and hence open the first and second fluid flow control valves 26, 28 allowing the first and second fluids 16, 18 to enter the drinking spout 22. The first and second fluid flow control valves 26, 28 may be sized in order to open only when negative pressure is applied to the drinking spout 22. In this manner the cup 10 may be turned upside down and the first and second fluids 16, 18 will still be prevented from exiting through the first and second fluid flow control valves 26, 28.

The cup 10 may also be vented in order to increase the ease at which the first and second fluids 16, 18 are dispensed therefrom. Upon removing the first and second fluids 16, 18 a negative pressure may build up inside the cup 10 and increase the amount of suction force needed to draw more of the first and second fluids 16, 18 from the cup 10. Negative pressure inside of cup 10 that acts to hinder dispensing may be eliminated by venting cup 10 such that first and second fluids 16, 18 removed therefrom are replaced with air. In accordance with other various exemplary embodiments of the present invention, however, the cup 10 may not have a vent system.

As shown in FIGS. 1 and 2, the lid 14 defines both a first vent 36 and a second vent 38. The flow control element 24 as shown in FIGS. 3 and 4 includes a first vent valve 40 and a second vent valve 42. The first and second vent valves 40, 42 may be configured in a manner similar to the first and second fluid flow control valves 26, 28 as discussed above. As can be seen in FIG. 4, the first and second vent valves 40, 42 may be each provided with a slit 44, 46 on one end thereof. The first vent 36 is placed into fluid communication with the chamber 30 through the first vent valve 40, and the second vent 38 is placed into fluid communication with the container 20 through the second vent valve 42. As shown in FIG. 3, the flow control element 24 defines a passageway 50 that places the container 20 into fluid communication with the second vent 38 through the second vent valve 42. In accordance with other exemplary embodiments of the present invention, the flow control element 24 or container 20 may be configured so that the passageway 50 is not necessary.

Figure 5:
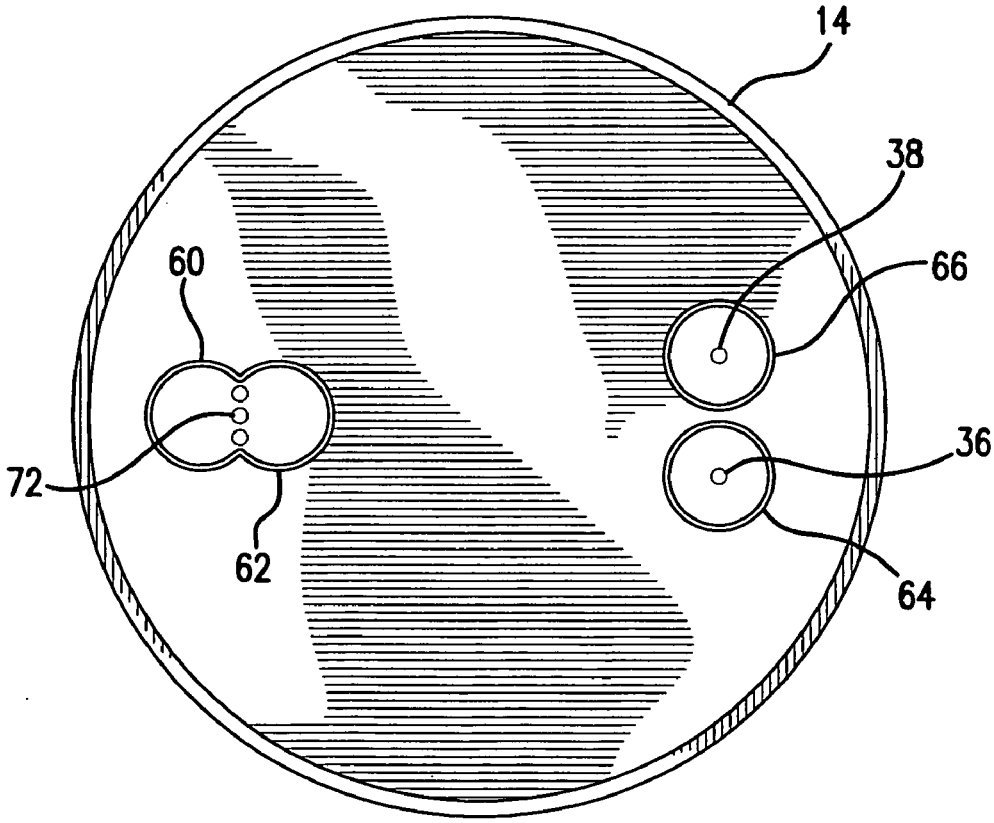
FIG. 5 is a bottom view of a lid used with the exemplary embodiment of the cup shown in FIGS. 1–3.

The first and second vents 36, 38 are sized such that an appropriate negative pressure inside of the chamber 30 and the container 20 will cause the slits 44, 46 to expand thereby opening the first and second vent valves 40, 42. In this manner air will be allowed to transfer into both the chamber 30 and the container 20 hence reducing the amount of suction force needed to be applied by the child in order to withdraw the first and second fluids 16, 18 from cup 10. The flow control element 24 may be made of a single integral piece of elastomeric material in accordance with one exemplary embodiment of the present invention. Alternatively, the flow control element 24 may be made of multiple components. For instance, each of the first and second fluid flow control valves 26, 28 along with the first and second vent valves 40, 42 may be individual components that are attached to one another. As shown in FIGS. 3 and 5, the lid 14 is provided with a series of receiving portions 60, 62, 64, and 66 that receive corresponding portions of the flow control element 24. The first and second fluid flow control valves 26, 28 are held into the first and second receiving portions 60, 62 through a friction fit engagement. Likewise, the first vent valve 40 is held into the third receiving portion 64 and the second vent valve 42 is held into the fourth receiving portion 66 by a friction fit engagement.

One or more of the fluid flow control valves 26, 28 or the vent valves 40, 42 may have substantially the same diameter through substantially its entire height. Also, although shown as using slits 32, 34, 44, and 46 it is to be understood that other configurations may be employed in order to allow the valves 26, 28, 40, and 42 to open. For instance, duck bill valves or flapper valves may be employed in accordance with other exemplary embodiments.

A parent may remove the flow control element 24 from the lid 14 in order to wash these two components. The flow control element 24 is provided with a handle 68 in order to assist a parent in grasping the flow control element 24 for ease of placement into a sink or dishwasher. The container 20 may also be releasably attachtable to the flow control element 24 in order to allow a parent to fill the container 20 with the second fluid 18 or to allow for better cleaning of the container 20. A connection member 70 is attached to the flow control elements 24 and is provided with a plurality of threads for engaging complimentary threading on the container 20. In accordance with other exemplary embodiments of the present invention, the connection member 70 is not a separate component attached to the flow control element 24. In this instance, the container 20 may be attached directly to the flow control element 24 without the need for an intervening component. Here, the flow control element 24 may be itself provided with threading for engagement with the container 20. Alternatively, the container 20 may be friction fit onto the flow control element 24, or the flow control element 24 may be provided with structure allowing for the container 20 to be snap-fit thereon.

Figure 6:
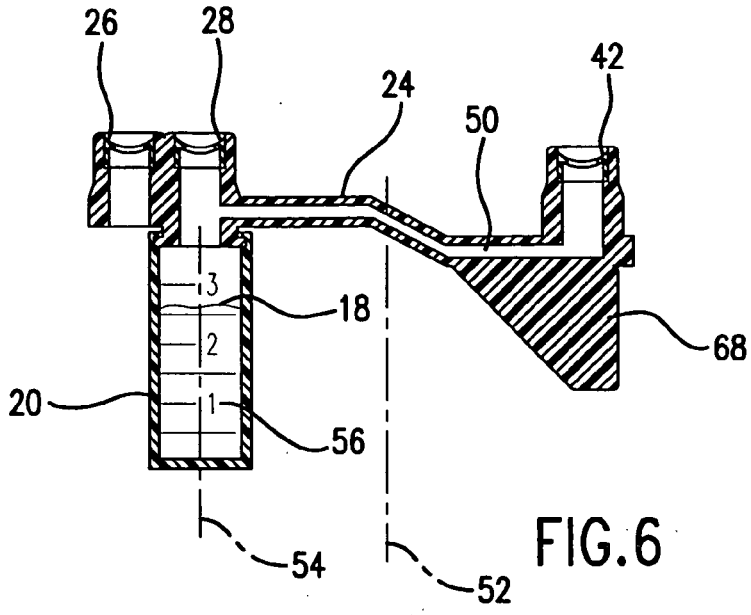
FIG. 6 is a cross-sectional view of a flow control element used in accordance with an alternative exemplary embodiment of the present invention.

The cup body 12 has a longitudinal axis 52, and the container 20 has a longitudinal axis 54. As shown in FIG. 3, the container 20 oriented such that the longitudinal axis 54 is inclined or angled with respect to the longitudinal axis 52. In accordance with one exemplary embodiment of the present invention, this orientation of the container 20 allows for an improved dispensing of the second fluid 18 therefrom. FIG. 6 shows an alternative exemplary embodiment of the present invention in which the longitudinal axis 54 of the container 20 is substantially parallel to the longitudinal axis 52 of the cup body 12 when the flow control element 24 is configured therewith.

Figure 7:
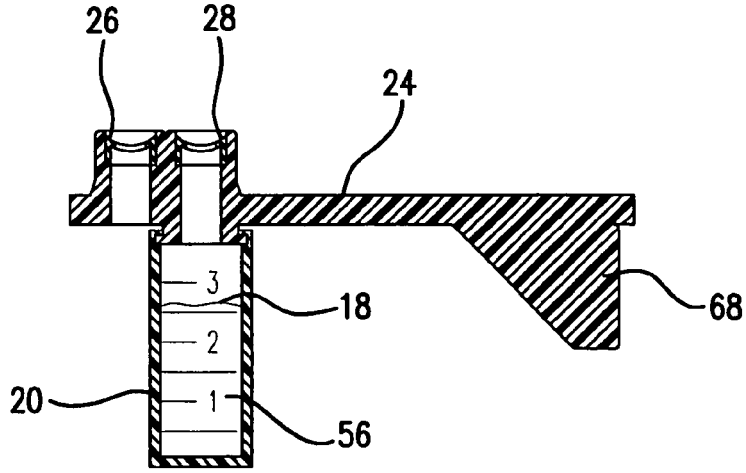
FIG. 7 is a cross-sectional view of a flow control element used in accordance with a further alternative exemplary embodiment of the present invention.
Figure 8:
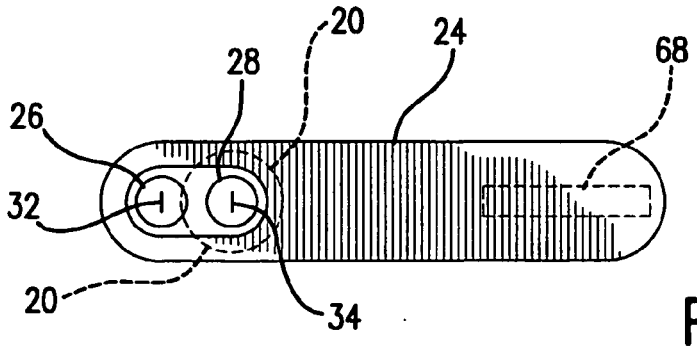
FIG. 8 is a top view of the flow control element shown in FIG. 7.

FIGS. 7 and 8 show an alternative exemplary embodiment of the present invention in which the flow control element 24 does not include a vent system as shown in previous exemplary embodiments. Further, the first and second fluid flow control valves 26, 28 have a substantially semi-circular cross-section. This type of configuration allows for the first and second fluid flow control valves 26, 28 to be more compact in size and hence allows for more flexibility in the design of the flow control element 24.

Figure 9:
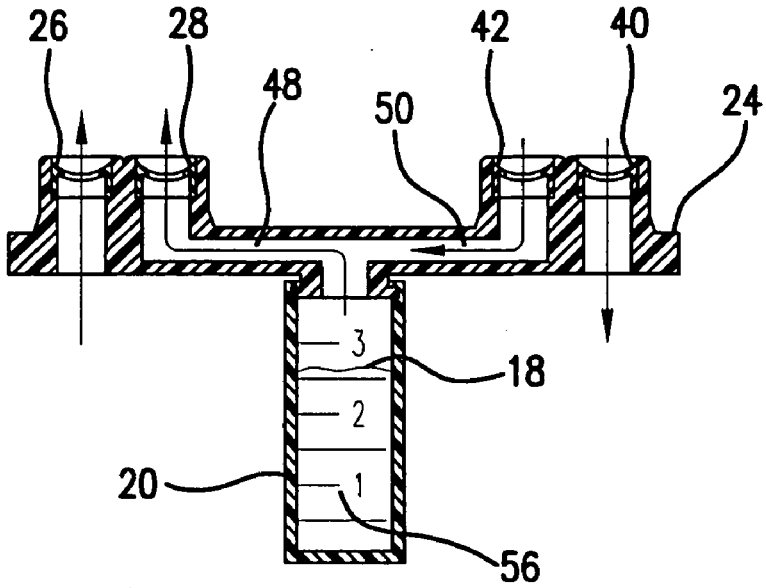
FIG. 9 is a cross-sectional view of a flow control element used in accordance with yet another exemplary embodiment of the present invention.
Figure 10:
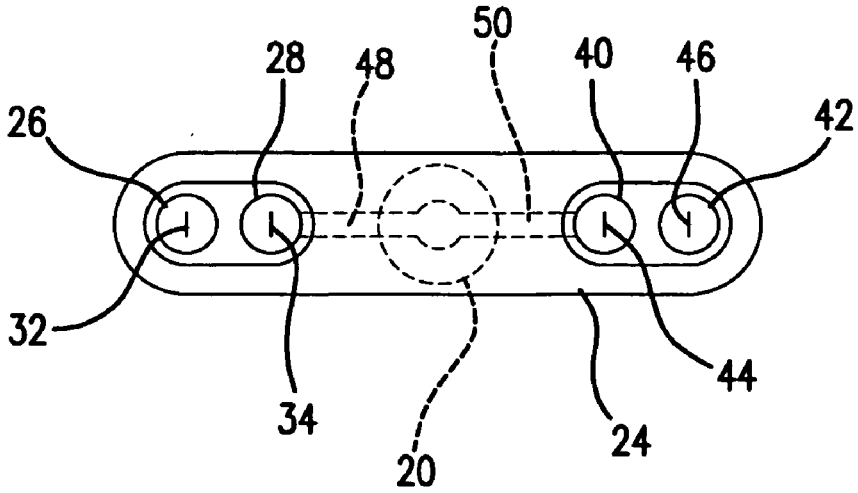
FIG. 10 is a top view of the flow control element shown in FIG. 9.

A further exemplary embodiment of the present invention is shown in FIGS. 9 and 10 that includes first and second fluid flow control valves 26, 28 similar to the ones disclosed in FIGS. 7 and 8. Further, the exemplary embodiment in FIGS. 9 and 10 includes a vent system that incorporates first and second vent valves 40, 42 that have semi-circular cross-sections. As shown in FIG. 9, the container 20 is located at the midpoint of the length of the flow control element 24. In this arrangement, the flow control element 24 defines passageway 48 along at least a portion of the length thereof in order to allow the container 20 to be placed into fluid communication with the second fluid flow control valve 28. As with previous exemplary embodiments, the container 20 may be vented with air supplied through passageway 50.

It should be understood that the present invention includes various modifications that can be made to the exemplary embodiments of the cup 10 as described herein the come within the scope of the appended claims and their equivalents.

What is claimed is:

1. A cup for administering medicine, comprising:

a cup body defining a chamber configured for holding a first fluid, the cup body defining an opening on one end;

a lid connected to the cup body in order to substantially cover the opening of the cup body, the lid having a drinking spout;

a flow control element connected to the lid, the flow control element having a first fluid flow control valve for regulating the dispensing of the first fluid from the chamber of the cup body to the drinking spout, and wherein the flow control element has a second flow control valve; and a container attached to the flow control element and configured for holding a second fluid, wherein the second flow control valve is configured for regulating the dispensing of the second fluid from the container to the drinking spout, wherein the first and second flow control valves are configured to keep separate the first fluid in the chamber of the cup body from the second fluid in the container after initial dispensing of the first and second fluids to the drinking spout.

2. The cup as set forth in claim 1, wherein the drinking spout is configured for allowing the first and second fluids to mix therein, and wherein the drinking spout is configured for dispensing the first and second fluids simultaneously.

3. The cup as set forth in claim 1, wherein the first fluid is a beverage and the second fluid is medicine.

4. The cup as set forth in claim 1, wherein the first and second flow control valves are made from an elastomeric material and are substantially cylindrically shaped members having an open end and a closed end with a slit defined therethrough.

5. The cup as set forth in claim 1, wherein the lid defines a first vent and a second vent, and wherein the flow control element has a first vent valve for regulating transfer of air from the first vent into the chamber of the cup body, and wherein the flow control element has a second vent valve for regulating transfer of air from the second vent into the container.

6. The cup as set forth in claim 5, wherein the first and second vent valves are made from an elastomeric material and are substantially cylindrically shaped members having an open end and a closed end with a slit defined therethrough.

7. The cup as set forth in claim 1, wherein the flow control element defines a passageway for placing the second fluid flow control valve into fluid communication with the container.

8. The cup as set forth in claim 1, wherein the flow control element defines a passageway for placing a second vent into fluid communication with the container.

9. The cup as set forth in claim 1, wherein the container and the cup body each have a longitudinal axis, and wherein the longitudinal axis of the container is parallel with the longitudinal axis of the cup body.

10. The cup as set forth in claim 1, wherein the container and the cup body each have a longitudinal axis, and wherein the longitudinal axis of the container is inclined with respect to the longitudinal axis of the cup body.

11. The cup as set forth in claim 1, wherein the container has indicia located thereon for indicating the amount of the second fluid held in the container.

12. A cup for administering medicine, comprising:

a cup body defining a chamber configured for holding a first fluid, the cup body defining an opening on one end;

a lid connected to the cup body in order to substantially cover the opening of the cup body, the lid having a drinking spout and the lid defining a first vent and a second vent;

a flow control element connected to the lid, the flow control element having a first fluid flow control valve for regulating the dispensing of the first fluid from the chamber of the cup body to the drinking spout, and wherein the flow control element has a first vent valve for regulating the transfer of air from the first vent into the chamber of the cup body, and wherein the flow control element has a second flow control valve, and wherein the flow control element has a second vent valve; and a container attached to the flow control element and configured for holding a second fluid, wherein the second flow control valve is configured for regulating the dispensing of the second fluid from the container to the drinking spout, and wherein the second vent valve is configured for regulating the transfer of air from the second vent into the container;

wherein the first and second flow control valves are made from an elastomeric material and are substantially cylindrically shaped members having an open end and a closed end with a slit defined therethrough, wherein the first and second flow control valves are configured to keep separate the first fluid in the chamber of the cup body from the second fluid in the container after initial dispensing of the first and second fluids to the drinking spout.

* * * * *